US010458416B2

(12) United States Patent
Mangutov et al.

(10) Patent No.: US 10,458,416 B2
(45) Date of Patent: Oct. 29, 2019

(54) APPARATUS AND METHOD FOR MONITORING A PUMP

(71) Applicant: Siemens Aktiengesellschaft, Munich (DE)

(72) Inventors: Oleg Vladimirovich Mangutov, St. Petersburg (RU); Ilya Igorevich Mokhov, St. Petersburg (RU); Nicolay Andreevich Veniaminov, St. Petersburg (RU); Alexey Petrovich Kozionov, St. Petersburg (RU)

(73) Assignee: Siemens Aktiengesellschaft, Munich (DE)

( * ) Notice: Subject to any disclaimer, the term of this patent is extended or adjusted under 35 U.S.C. 154(b) by 160 days.

(21) Appl. No.: 15/532,451

(22) PCT Filed: Dec. 2, 2014

(86) PCT No.: PCT/RU2014/000901

§ 371 (c)(1),
(2) Date: Jun. 1, 2017

(87) PCT Pub. No.: WO2016/089237

PCT Pub. Date: Jun. 9, 2016

(65) Prior Publication Data

US 2017/0268517 A1 Sep. 21, 2017

(51) Int. Cl.
*F04D 15/02* (2006.01)
*F04D 1/00* (2006.01)
(Continued)

(52) U.S. Cl.
CPC ..... *F04D 15/0281* (2013.01); *F04B 51/00* (2013.01); *F04D 1/00* (2013.01);
(Continued)

(58) Field of Classification Search
CPC ..... F04D 15/0281; F04D 27/001; F04D 1/00; F04D 15/0088; F04D 15/0245; F04B 51/00
See application file for complete search history.

(56) References Cited

U.S. PATENT DOCUMENTS

2007/0212210 A1 9/2007 Kernan et al.
2012/0247200 A1 10/2012 Ahonen et al.
(Continued)

FOREIGN PATENT DOCUMENTS

CN 101907088 12/2010
CN 101949382 1/2011

OTHER PUBLICATIONS

Zhong, Rui et al., "An Improved Nonlinear Model of Switched Reluctance Motor with Losses" Industrial Electronics (ISIE), 2013 IEEE International Symposium on, IEEE, May 28, 2013, pp. 1-6.

*Primary Examiner* — Justin Seo
*Assistant Examiner* — John M Royston
(74) *Attorney, Agent, or Firm* — Cozen O'Connor

(57) ABSTRACT

An apparatus for monitoring of a pump includes a control module, and an error detection unit, wherein a support vector machine based module is provided that receives an estimated output quantity data value from the control module, processes the estimated output quantity data value to provide a processed estimated output quantity data value via the support vector machine, and supplies the processed estimated output quantity data value to the error detection unit instead of the estimated output quantity data value of the control module.

11 Claims, 5 Drawing Sheets

(51) Int. Cl.
*F04D 15/00* (2006.01)
*F04B 51/00* (2006.01)
*F04D 27/00* (2006.01)

(52) U.S. Cl.
CPC ..... *F04D 15/0088* (2013.01); *F04D 27/001* (2013.01); *F04D 15/0245* (2013.01)

(56) References Cited

U.S. PATENT DOCUMENTS

2012/0251340 A1 10/2012 Ahonen et al.
2013/0238147 A1* 9/2013 Okamoto ..... H02H 7/093 700/282
2015/0122037 A1* 5/2015 Obaia ..... F04D 15/0088 73/660
2016/0055737 A1* 2/2016 Boken ..... F04B 49/10 340/679

* cited by examiner

APPARATUS AND METHOD FOR MONITORING A PUMP

CROSS-REFERENCE TO RELATED APPLICATIONS

This is a U.S. national stage of application No. PCT/RU2014/000901 filed 2 Dec. 2014.

BACKGROUND OF THE INVENTION

1. Field of the Invention

The present invention relates to an apparatus and method for monitoring a pump.

2. Description of the Related Art

Centrifugal pumps are widely used in different technical areas. They are used, for example, in oil production, city water supply systems or waste water removal. Such pumps are often used in heavy conditions and/or in a 24-hour regime. Such pumps are regularly expensive and voluminous components, especially when they form part of the infrastructure of a city or a region. A failure of such a pump is usually an important and cost-intensive incident. The failure of a pump may occur suddenly or slowly with degradation of pump characteristics by the time.

In water supply systems, pumps are usually grouped inside pump stations. Pump failure may lead to damage of equipment, serious technical hazards, and interruption in supply or shortage of overall system performance. Preventive detection of pump failures is a challenging task and requires an application of modern methods.

SUMMARY OF THE INVENTION

In view of the foregoing, it is therefore an object of the invention to improve the failure detection of a pump.

This and other objects and advantages are achieved in accordance with the invention by an apparatus, a method and a computer program product, where the apparatus comprises a control module configured to receive at least one signal representing an operational parameter of the pump, and to estimate an estimated output quantity data value of the pump based on the signal of the operational parameter, and a error detection unit configured to receive the estimated output quantity data value from the control module, receive a measured output quantity data value of the pump provided by a sensor, provide a difference data value by subtracting the estimated output quantity data value from the measured output quantity data value, compare the difference data value with a predetermined threshold value and to provide a corresponding comparison result, and to output an error status signal of the pump based on the comparison result.

The objects of the invention are also achieved by a method for monitoring of a pump, where the method comprises receiving at least one signal representing an operational parameter of the pump, estimating an estimated output quantity data value of the pump based on the signal of the operational parameter, receiving the estimated output quantity data value from the control module, receiving a measured output quantity data value of the pump provided by a sensor, providing a difference data value by subtracting the estimated output quantity data value from the measured output quantity data value, comparing the difference data value with a predetermined threshold value and providing a corresponding comparison result, and outputting an error status signal of the pump based on the comparison result. Finally, the invention further relates to a computer program product.

In accordance with a first apparatus-related embodiment, the apparatus has a support vector machine based module that is configured to receive the estimated output quantity data value from the control module, process the estimated output quantity data value to provide a processed estimated output quantity data value by use of the support vector machine, and to supply the processed estimated output quantity data value to the error detection unit instead of the estimated output quantity data value of the control module.

In accordance with a second method-related embodiment the method comprises the additional steps of receiving the estimated output quantity data value from the control module by a support vector machine based module, processing the estimated output quantity data value by the support vector machine to provide a processed estimated output quantity data value and supplying the processed estimated output quantity data value instead of the estimated output quantity data value of the control module for the purpose of subtracting.

The disclosed embodiments of the invention are based on the fact that a failure of a pump can be detected in advance when surveying at least one parameter of the pump and considering further at least one output quantity of the pump. In one embodiment, vibration analysis of the pump is used. A vibration sensor is installed at the pump. This allows monitoring of pump vibrations to determine the actual error condition of the pump. Moreover, in accordance with another embodiment, a pump system model is used for fault detection, where all parameters of the pump are preferably measured. Deviation of such a system from the model indicates abnormal behaviour, which allows fault detection in advance. This may provide good results in fault detection but design of such a system is challenging because models are strongly affected by external or specific conditions.

The term "estimated output quantity data value" refers to a signal or a data value, respectively, which is the result of estimation by the control module. The estimated output quantity data value is an output signal or output data value of the control module. The term "processed estimated output quantity data value" is a signal or a data value, respectively, which is result of operating by the support vector machine. It is an output signal or data value, respectively, of the support vector machine based module.

Additionally, if the pump is driven by an electric motor, detection of pump motor failures can be provided by use of a motor current signature analysis method. This method is based on analysis of motor current consumption. This allows for different types of faults to be detected, but requires measuring the motor current with a high sampling rate. This is challenging for many pump applications.

In this regard, the disclosed embodiments of the invention provides an apparatus and a method based on comparison of a metered pump parameter with dependencies given by a pump specification, especially H-Q curve-based model, which is additionally corrected by a machine learning support vector machine (SVM) regression.

Additionally, the SVM model is added, which enhances the estimated output of the pump specification model with regard to real output quantity by resulting in a smaller error than merely the simple use of the H-Q-model. This allows for more accurate pump monitoring and, especially, enhances prediction of failure.

Preferably, in machine learning, support vector machines (also referred to as support vector networks) are supervised learning models with associated learning algorithms that analyze data and recognize patterns, used for classification and regression analysis. Given a set of training examples, each marked as to belong to one of two categories, an SVM training algorithm builds a model that assigns new examples into one category or the other, making it a non-probabilistic binary linear classifier. An SVM model is a representation of the examples as points in space, mapped so that the examples of the separate categories are divided by a clear gap that is as wide as possible. New examples are then mapped into that same space and predicted to belong to a category based on which side of the gap they fall on. In addition to performing linear classification, a SVM can efficiently perform a non-linear classification using what is called the kernel trick, implicitly mapping their inputs into high-dimensional feature spaces. More formally, a support vector machine preferably constructs a hyperplane or set of hyperplanes in a high- or infinite-dimensional space, which can be used for classification, regression, or other tasks. Intuitively, a good separation can be achieved by the hyperplane that has the largest distance to the nearest training data point of any class, so-called functional margin, because in general the larger the margin the lower the generalization error of the classifier.

In order to train the SVM model, real data of the pump is used, and the SVM is adjusted to real operational conditions of the pump. This combined model is also termed an H-Q-SVM model. In general, the machine learning system comprises two stages, i.e., a first stage, which represents a training stage or learning stage, respectively, and a second stage, which represents a testing stage or maintenance stage, respectively, which belongs to the intended operation of the apparatus.

In the training stage, measured data of the operational parameter of the pump is used to train the SVM, especially, the machine-learning algorithm comprised of the SVM. In the testing stage, the methods learned by the machine during the training stage are used for the intended monitoring of the pump. In real life applications, the training stage can be applied iteratively. For example, the algorithm may be trained in an online mode or by batch training. For example, the algorithm may collect data in some batch with time delay and then uses the collected data for training.

The apparatus can be a hardware component, which may include electric circuitry, a computer, combinations thereof, or the like. The apparatus may also comprise a silicone chip providing an electric circuitry establishing the afore-mentioned components. The apparatus may further be in communication with a communication network, such as a local area network (LAN) the internet, or the like, preferably via a communication interface.

The control module is a component of the apparatus that, in turn, may comprise itself an electric circuitry, a computer or combinations thereof. However, in another embodiment, the control module may be integral with the apparatus. The control module has at least one input connector, which allows the control module to receive at least one signal representing an operational parameter of the pump. The operational parameter of the pump can be provided by a respective sensor, which is connected to the pump in order to detect the respective parameter. The operational parameter of the pump may by a rotational speed, a pressure difference between in- and output, a flow of the medium to be pumped, a temperature, vibrations or combinations thereof.

The control module is configured to estimate an estimated output quantity data value of the pump based on the signal of the operational parameter. For this purpose, the control module preferably uses a pump specification module, especially a pump specification H-Q-curve-based model. This allows for the control module to estimate the output quantity, which should be physically provided at the output of the pump. However, in reality, deviations appear between the estimated output quantity data value and the real output quantity data value provided by the pump. This difference can be further processed to determine whether the pump is going to fail or is still in normal operation mode. Preferably, a prediction can be provided that a failure may appear in the nearest future, especially, for the intended use of the disclosed embodiments of the invention in the area of infrastructure. This is an advantage in order to enhance reliability of the infrastructure. So, the failure detection of a pump can be improved by use of the disclosed embodiments of the invention.

The apparatus further comprises the error detection unit, which is configured to receive the estimated output quantity data value from the control module. Generally, the error detection unit can be integral with the control module. However, it can also be a separate component. The error detection unit is configured to receive a measured output quantity data value of the pump provided by a sensor. The output quantity data value can be an output flow of the pump, an output pressure of the pump, or a combination thereof. Consequently, the sensor may be connected to the pump to provide the respective value. The sensor may be a separate component or the sensor may be integral with the apparatus.

The error detection unit is further configured to provide a difference data value by subtracting the estimated output quantity data value from the measured output quantity data value. This difference data value is compared with a predetermined threshold value to receive a comparison result. Depending on the comparison result, an output error status signal of the pump is provided, preferably output from the error detection unit, preferably the apparatus. This signal can be used for indicate the error status of the pump, such as by indicating visually or acoustically combinations thereof. Moreover, this signal may be communicated to a central monitoring station.

In accordance with the invention, the support vector machine based module is configured to receive the estimated output quantity data value from the control module, process the estimated output quantity data value in order to provide a processed estimated output quantity data value, and to supply the processed estimated output quantity data value to the error detection unit instead of the estimated output quantity data value of the control module. Consequently, the input of the error detection unit is replaced by an output signal, which is provided by the support vector machine based module. In turn, the output signal of the control module, now serves as an input signal for the support vector machine based module. As a result, the use of the support vector machine based module allows enhancement of the accuracy of the estimated output quantity data value of the pump so that, last but not least, the prediction or decision of the error status, respectively, can be improved. This is achieved by further operation of the estimated output quantity data value delivered by the control module by use of the support vector machine based module.

The error detection unit therefore has an improved estimated output quantity data value for the purpose of providing the difference data value.

In accordance with an embodiment, the support vector machine based module is configured to operate machine-learning support vector machine regression. This allows for the support vector machine model to estimate function which has the H-Q model output flow as an input and estimates a real output flow of the pump.

In regression formulation, one goal is to estimate an unknown continuous function based on a finite set of noisy samples $(x_i, y_i)$, $(i=1, \ldots, n)$, where $x \varepsilon R^d$ is a d-dimensional input and $y \varepsilon R$ is an output. The assumed statistical model for data generation is in accordance with the following relationship:

$$Y=r(x)+\delta \quad \text{Eq. 1}$$

Where r (x) is unknown target function (regression), and δ is an additive zero mean noise with noise variance σ.

In SVM regression, the input x is first mapped onto a m-dimensional feature space using some fixed, e.g., nonlinear, mapping, and then a linear model is constructed in this feature space. Using mathematical notation, the linear model or in the feature space, respectively, f (x, ω) is given by $$f(x,\tilde{\omega})\Sigma_{j=1}^{m}\tilde{w}_k g_i(x)+b \quad \text{Eq. 2}$$

Where $g_i(x)$, k=1, . . . , m denotes a set of nonlinear transformations, and b is the "bias" term. Often the data are assumed to be zero mean, so the previously mentioned bias term is dropped. This can be achieved by pre-processing.

In accordance with a further embodiment of the invention, the support vector machine based module is configured to be trained with real data of operational parameters of the pump. For this purpose, real data of the pump can be recorded, and, during a training stage, these data can be used to train the support vector machine based module or its algorithm, respectively. This allows for the support vector machine to be precisely processed to the real operation of the pump.

According to a further embodiment, the control module is configured to receive signals of all operational parameters of the pump and to estimate the estimated output quantity data value based on all signals of the operational parameters. This allows the further improvement of the accuracy of the monitoring of the pump. For example, for the operational parameters, individual sensors can be provided at the pump. The control module is preferably provided with respective connectors so that each of the sensors can be connected with the control module.

In accordance with another embodiment of the invention, the control module is configured to estimate the estimated output quantity data value based on an H-Q model which, in turn, is based on H-Q-curves provided by a manufacturer of the pump. This allows further improvement of the accuracy of monitoring of the pump. In particular, certain information relating to the design of the pump can be additionally considered.

In accordance with an exemplary embodiment, the apparatus is configured to monitor a centrifugal pump. A plurality of applications can be provided with the invention, especially, the invention is suited to be retrofit in already operating systems.

In accordance with another exemplary embodiment, the control module is configured to detect an electric parameter of an electric machine driving the pump. The electric parameter is preferably also an operational parameter. This allows further enhancing the monitoring of the pump.

In accordance with yet another exemplary embodiment, the error detection unit is configured to calculate the threshold value from a root mean square (RMS) of a predetermined number of difference data values. This allows the threshold value to be easily received. Preferably, the predetermined number is a figure between 2 and 25, preferably between 2 and 7, most preferably 3, of preferably predetermined difference data values. The predetermined difference data values may be subsequent values or they may be elected according to a predetermined prescription.

In accordance with a further embodiment of the invention, one or more computer program products include a program for a processing device, comprising software code portions of a program for performing the steps of the method in accordance with the invention when the program is executed on the processing device. The computer program products comprise further computer-executable components which, when the program is executed on a computer, are configured to perform the respective method as referred to herein above. The above computer program product/products may be formed as a computer-readable storage medium.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The teachings of the present inventions can be readily understood and at least some additional specific details will appear by considering the following detailed description of at least one exemplary embodiment in conjunction with the accompanying drawings, showing schematically the invention applied to monitoring of a centrifugal pump, in which.

DETAILED DESCRIPTION OF THE EXEMPLARY EMBODIMENTS

Figure 1:
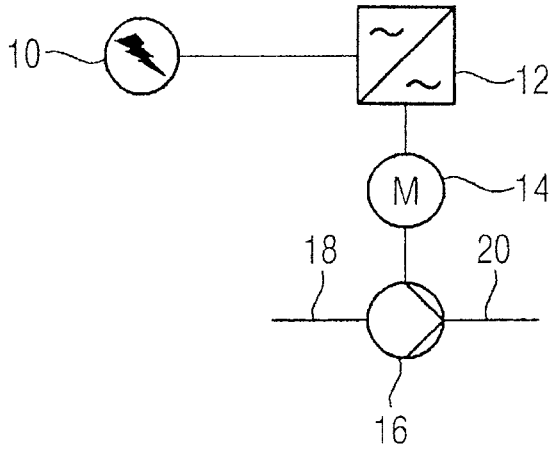
FIG. 1 shows schematically a scheme for a centrifugal pump in accordance with the invention.

FIG. 1 shows schematic a block diagram of a pump arrangement 52 comprising a centrifugal pump 16 having an inlet 18 for auction of water, and an outlet 20 for providing the output flow of the pump 16. The pump 16 is driven by an electric motor 14 which, in turn, is supplied with electric energy by a frequency converter 12. The frequency converter 12, in turn, is connected with a power supply network 10 to supply the frequency converter 12 with electric energy.

Figure 2:
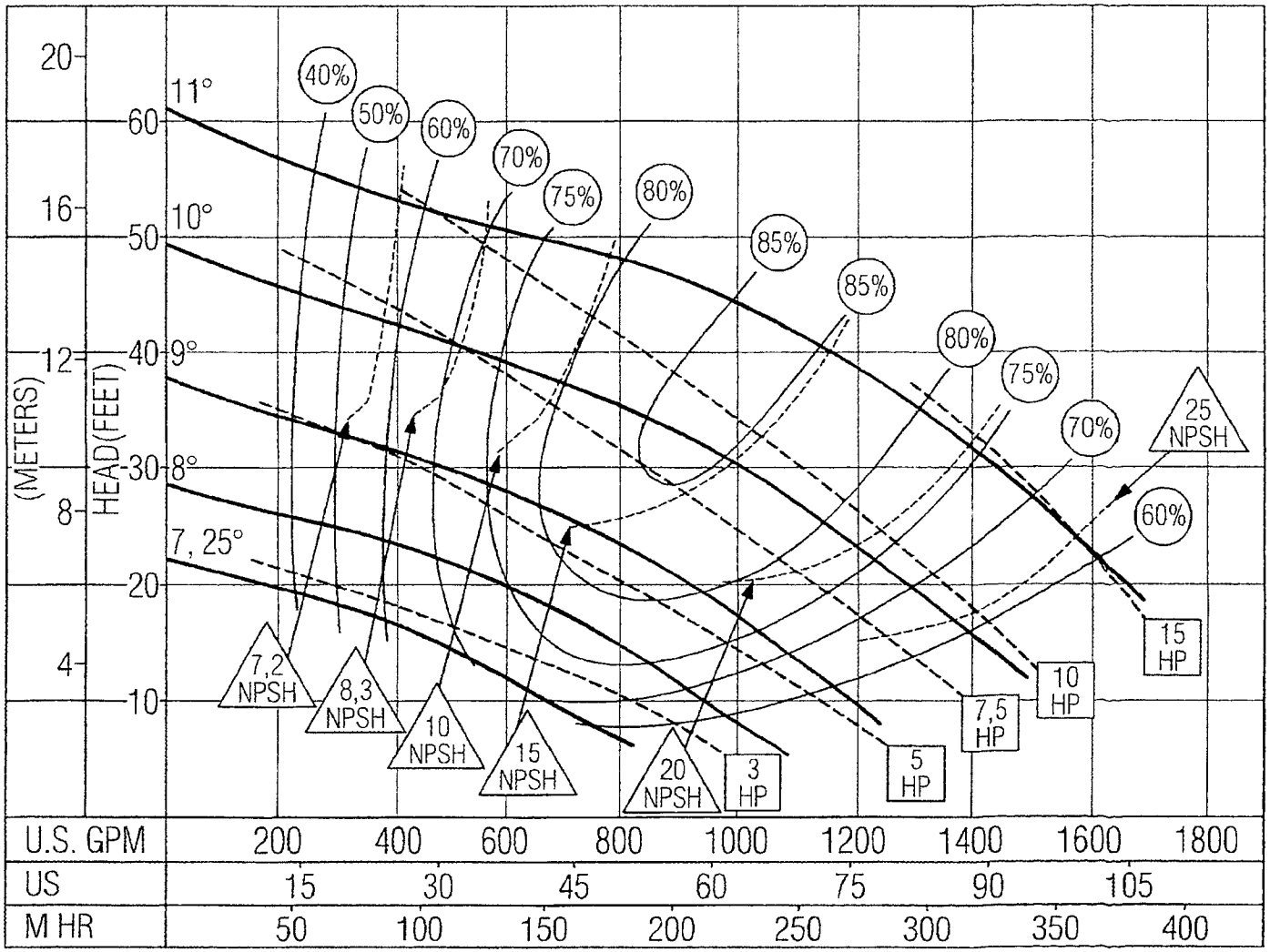
FIG. 2 is a graphical plot of H-Q-curves for the pump of FIG. 1.

FIG. 2 shows a graphical plot H-Q-curves of the pump 16 that is usually provided by a manufacturer of the pump 16. This diagram shows the relationship between the volume flow of the pump 16 and a pressure difference between inlet 18 and outlet 20 at a constant speed of a pump crank of the pump 16. The pressure difference is also referred to as "head".

Figure 4:
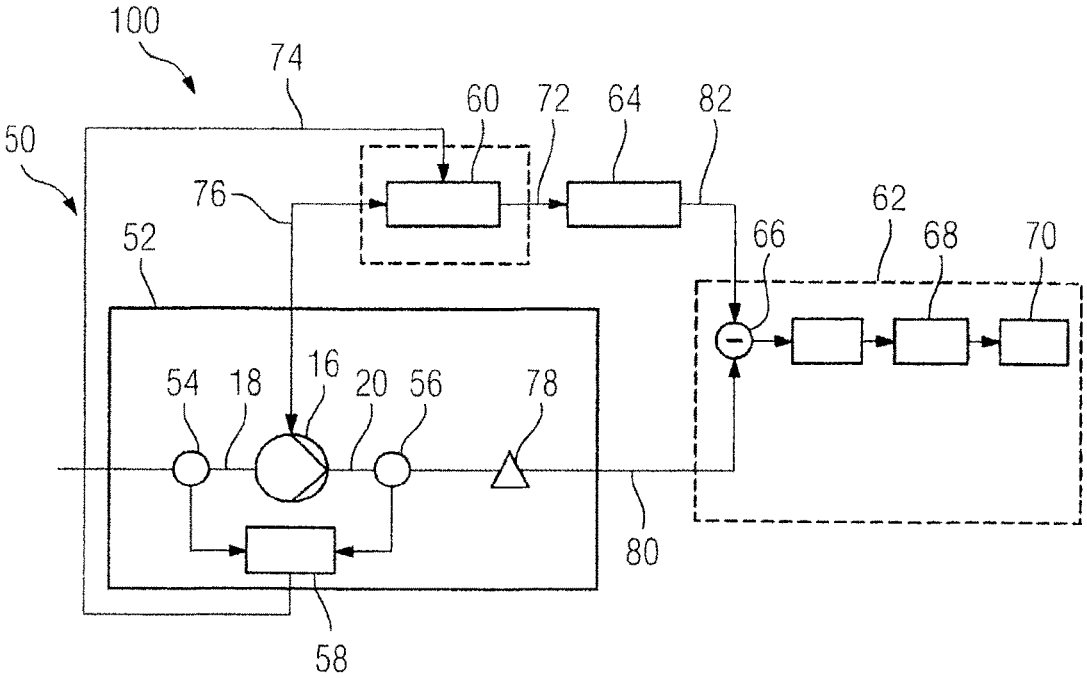
FIG. 4 is a block schematic diagram of the pump of FIG. 1 connected with an apparatus in accordance with the invention.

FIG. 4 shows a schematic block diagram of an apparatus 100 for monitoring of the centrifugal pump 16. The apparatus 100 is an apparatus in accordance with the invention. The apparatus 100 comprises a control module 60 which is configured to receive two signals representing operational parameters 74, 76 of the centrifugal pump 16. Presently, the operational parameter 74 refers to a "head" of the centrifugal pump 16, whereas the operational parameter 76 refers to a frequency that relates to the rotation of the centrifugal pump 16. In other embodiments, different or additional operational parameters can be considered.

The control module 60 is further configured to estimate an estimated output quantity data value 72 of the pump 16, where estimation is based on the signals of the operational parameters 74, 76. For estimation purposes, the control module 60 uses for the purpose of estimation a H-Q-model estimation 34 which, in turn, is based on pump curves (FIG. 2) provided by the manufacturer of the centrifugal pump 16. The estimated output quantity data value 72 is an output value of the control module 60, which is provided for further processing of the apparatus 100.

FIG. 4 shows a pump arrangement 52 comprising the centrifugal pump 16. The operational parameter 76 impinges on the centrifugal pump 16. At the inlet 18 site, the centrifugal pump 16 comprises a first pressure sensor 54, whereas, at the outlet 20, a second pressure sensor 56 is provided. The pressure sensors 54, 56 provide signal to a head unit 58 that calculates the head of the signals supplied by the pressure sensors 54, 56. The head unit 58 provides the operational parameter 74 as an output that is supplied to the apparatus 100, i.e., to the control module 60.

The apparatus 100 further comprises an error detection unit 62. The error detection unit 62 is configured to receive a measured output quantity data value 80 of the pump 16 that is provided by a sensor 78. In the present embodiment, the measured output quantity data value refers to a volume flow at the outlet 20 of the centrifugal pump 16. In the present embodiment, the sensor 78 forms part of the pump arrangement 52.

In accordance with the invention, the apparatus 100 further includes a support vector machine based module 64 that is configured to receive the estimated output quantity data value 72 from the control module 60. The support vector machine 64 processes the estimated output quantity data value 72 to provide a processed estimated output quantity data value 82 as an output. The processed estimated output quantity data value 82 is supplied to the error detection unit 62 instead of the estimated output quantity data value 72 of the control module.

The error detection unit 62 is further configured to provide a difference data value by subtracting 66 the processed estimated output quantity data value 82 from the measured output quantity data value 80. The difference data value is compared 68 with a predetermined threshold value. In response hereto, the error detection unit 62 outputs an error status signal 70 of the centrifugal pump 16 based on the result of comparing.

Figure 3:
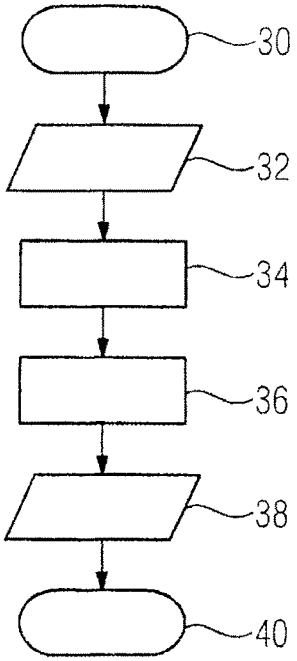
FIG. 3 is a flow chart for estimation training in a training stage of the H-Q SVM model in accordance with the invention.

FIG. 3 shows schematically, in an exemplary embodiment, a flow chart of the operation of the training stage of the apparatus 100 in accordance with the invention. The method starts at 30. At 32, pump normalized characteristics from a pump specification provided by the manufacturer (FIG. 2) is input. At 34, a H-Q-model estimation is provided by the control module 60. Next, at step 36, estimation by the support vector machine based module is executed. As an output at 38, H-Q support vector machine model is provided. The method terminates at 40. FIG. 3 thus shows estimation training of the apparatus 100 in accordance with the invention.

The quality of the estimation with the apparatus in accordance with the invention can be measured by a loss function, as detailed below.

The quality of estimation is measured by the loss function $L(y,f(x,\omega))$. SVM regression uses a new type of loss function, i.e., ε-insensitive loss function:

$$L_\varepsilon = (\gamma, f(x, \overline{\omega})) = \left\{ \begin{array}{ll} 0 & \text{if } |y - f(x, \overline{\omega})| \le \varepsilon \\ |y - f(x, \overline{\omega})| - \varepsilon & \text{otherwise} \end{array} \right\} \quad \text{Eq. 3}$$

The empirical risk is:

$$R_{exp}(\overline{\omega}) = \frac{1}{n} \Sigma_{i=1}^{n} L_g(y_i, f(x, \overline{\omega})) \quad \text{Eq. 4}$$

It should be noted that ε-insensitive loss coincides with least-modulus loss and with a special case of Huber's robust loss function when ε=0. Hence, it can compare prediction performance of SVM, with proposed chosen ε, with regression estimates obtained using least-modulus loss (ε=0) for various noise densities.

In the following, the algorithm is described which is used by the disclosed embodiments of the invention.

The algorithm comprises a training stage as a first stage and a test stage as a second stage. The training stage is shown in accordance with FIG. 3, where the test stage is depicted by FIG. 4.

In the training stage, an H-Q-model is estimated in accordance with step 34 by using pump characteristics from a pump specification of the manufacturer. Input parameters are presently a pump current frequency that is derivable from current to be measured at the electric motor 14, as well as a pump head provided by the head unit 58. As an output, the pump flow is used, which is provided by the sensor 78.

Second, the support vector machine model is estimated that describes dependencies between real demand and output. For estimation purposes, the output of the pump flow of the H-Q-model is used as an input. The output is an estimated output flow of the pump 16.

In the test stage, the combined H-Q-SVM-model is used for output flow estimation of the pump 16. Next, an error calculation of the H-Q-SVM-model is provided. In a following step, the H-Q-SVM-model error output is compared with thresholds which, in the present embodiment, are an upper and a lower threshold. Both of these thresholds together provide a band, where the signal outside the band represents a failure or error, respectively of the pump 16. This is shown with regard to FIGS. 5 to 7.

Figure 5:
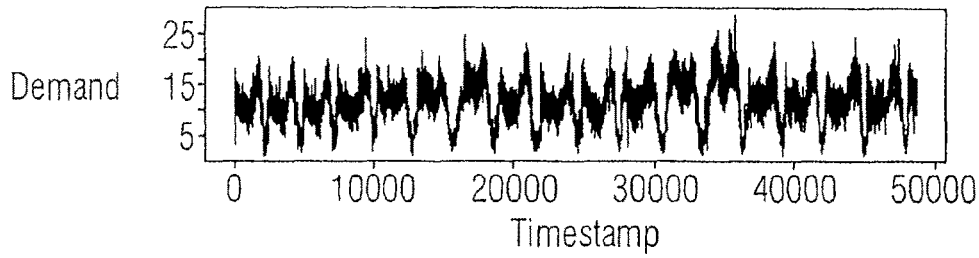
FIG. 5 is a diagram schematically showing real data of the pump of FIG. 1.
Figure 6:
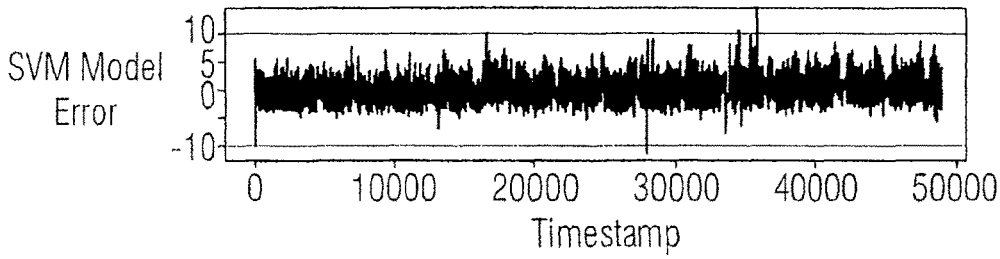
FIG. 6 is a diagram schematically showing a model error and two threshold values.
Figure 7:
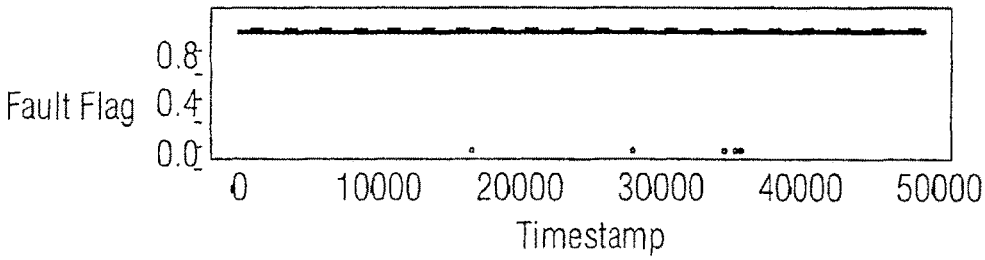
FIG. 7 a diagram schematically showing a fault index, where an index in the range of 1 relates to normal behaviour of the pump and an index of the range of 0 relates to an abnormal behaviour of the pump.

In the diagram of FIG. 5, the real output and the output of the estimation are shown. FIG. 6 shows the error of the model with regard to the upper and the lower thresholds. FIG. 7 shows failures, whereas a value of a fault flag about 0 represents a failure, whereas a fault flag with a value of about 1 represents normal operation of the pump 16.

The operation of the support vector machine based module 64 is further detailed with reference to FIG. 8. Presently, a neural cloud classification algorithm is used as a support vector machine. The estimation of a membership function preferably consists of two steps: First, clustering by the advanced K means (AKM) clustering algorithm and, second, an approximation of clusters by radial basic functions (RBF) network approach (see FIG. 8). AKM is a modification of the K means algorithm with an adaptive calculation of optimal number of clusters for given maximum number of clusters (centroids).

AKM itself preferably consists of the following steps:

Set an initial number of K centroids and a maximum and minimum bound.

Call k-means algorithm to position K centroids.

Insert or erase centroids according to the following premises:

If the distances of data are above a certain distance from the nearest centroid, then generate a new centroid.

If any cluster consists of less than a certain number of data, then remove the corresponding centroid.

If the distance between some centroids is smaller than a certain value, then combine those clusters to one.

Loop to step 2 unless a certain number of epochs is reached, or centroids number and their coordinates have become stable.

The output of the AKM algorithm is centers of clusters that represent historical data related to normal behaviour. This is used as a training set. After all, the centers of clusters have been extracted from the input data, the data is encapsulated with a hypersurface (membership function). For this purpose, Gaussian distributions (Gaussian bell) are used.

$$R_i = e^{\frac{|x-m_i|}{2\sigma^2}} \quad \text{Eq. 5}$$

where $m_i$ are centers of the Gaussian bell, σ is a width of the Gaussian bell, x is input data.

Figure 8:
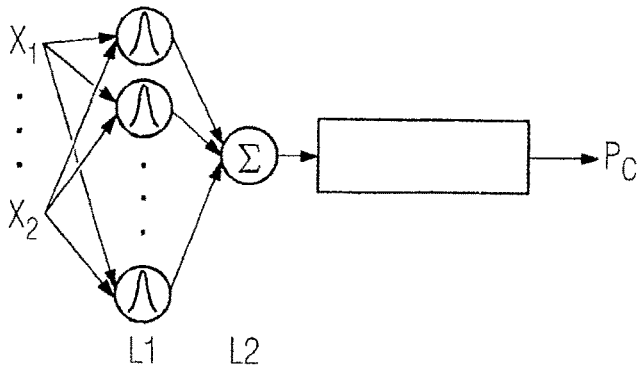
FIG. 8 is a schematic block diagram depicting a radial basic functions (RBF) network approach.

The centers AKM clusters are allocated to centers of corresponding Gaussian bells, as can be seen from FIG. 8 with respect to L1. The sum of all Gaussian bells is calculated to obtain the membership function. The sum of the Gaussian bells shall be preferably a unit in case of these bells overlap. Next, normalization is applied to set the confidence values $p^c$ calculated by neural clouds in boundaries between 0 to 1 (see FIG. 8).

The neural clouds encapsulate all previous history of selected parameters for a given training period. After training, the neural clouds calculate a confidence value for every new status of the pump 16, describing the confidence value of normal behaviour.

In accordance with the invention, the one-dimensional neural clouds construct membership function for the model error of thermal-mechanical fatigue (TF) simulation and provides a fuzzy output of confidence values between 0 and 1.

If desired, the different functions and embodiments discussed herein may be performed in a different or a deviating order and/or currently with each other in various ways. Furthermore, if desired, one or more of the above-described functions and/or embodiments may be optional or may be combined, preferably in an arbitrary manner.

Although various aspects of the invention are set out in the independent claims, other aspects of the invention comprise other combinations of the features from the described embodiments and/or the dependent claims with the features of the independent claims, and not solely the combinations explicitly set out in the claims.

It is also observed herein that, while the above describes exemplary embodiments of the invention, this description should not be regarded as limiting the scope. Rather, there are several variations and modifications which may be made without departing from the scope of the present invention as defined in the appended claims.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus for monitoring a pump, the apparatus comprising:

a control module configured to:

receive at least one signal representing an operational parameter of the pump, and estimate an estimated output quantity data value of the pump based on the signal representing the operational parameter;

a support vector machine based module configured to:

receive the estimated output quantity data value from the control module, process the received estimated output quantity data value to provide a processed estimated output quantity data value based on a combined H-Q-SVM model via the support vector machine based module, and supply the processed estimated output quantity data value to the error detection unit instead of the estimated output quantity data value of the control module; and an error detection unit configured to:

receive the processed estimated output quantity data value from the support vector machine based module, receive a measured output quantity data value of the pump provided by a sensor, provide a difference data value by subtracting the processed estimated output quantity data value from the measured output quantity data value, compare the difference data value with a predetermined threshold value and provide a corresponding comparison result, and output an error status signal of the pump based on a result of the comparison.

2. The apparatus according to claim 1, wherein the support vector machine based module is further configured to operate machine learning support vector machine regression.

3. The apparatus according to claim 1, wherein the support vector machine based module is configured to be trained with real data of operational parameters of the pump.

4. The apparatus according to claim 2, wherein the support vector machine based module is configured to be trained with real data of operational parameters of the pump.

5. The apparatus according to claim 1, wherein the control module is further configured to receive signals for all operational parameters of the pump and configured to estimate the estimated output quantity data value based on all signals of the operational parameters.

6. The apparatus according to claim 1, wherein the control module is further configured to estimate the estimated output quantity data value based on an H-Q-model which, in turn, is based on H-Q-curves provided by a manufacturer of the pump.

7. The apparatus according to claim 1, wherein the apparatus is configured to monitor a centrifugal pump.

8. The apparatus according to claim 1, wherein the control module is further configured to detect an electric parameter of an electric machine driving the pump.

9. The apparatus according to claim 1, wherein the error detection unit is further configured to calculate the predetermined threshold value from a Root Mean Square of a predetermined number of difference data values.

10. A method for monitoring a pump, the method comprising:

receiving at least one signal representing an operational parameter of the pump;

estimating an estimated output quantity data value of the pump based on a signal of the operational parameter;

receiving the estimated output quantity data value from a control module;

processing the received estimated output quantity data value by a support vector machine based module to provide a processed estimated output quantity data value based on a combined H-Q-SVM model via the support vector machine based module;

supplying the processed estimated output quantity data value to an error detection unit instead of the estimated output quantity data value of the control module;

receiving the processed estimated output quantity data value from the support vector machine based module;

receiving a measured output quantity data value of the pump provided by a sensor;

providing a difference data value by subtracting the processed estimated output quantity data value from the received measured output quantity data value;

comparing the difference data value with a predetermined threshold value and providing a corresponding comparison result; and outputting an error status signal of the pump based on a result of the comparison.

11. A non-transitory computer program product including a computer program executing on a processing device to monitor a pump, said program comprising:

software code portions for receiving at least one signal representing an operational parameter of the pump;

software code portions for estimating an estimated output quantity data value of the pump based on a signal of the operational parameter;

software code portions for receiving the estimated output quantity data value from a control module;

software code portions for processing the received estimated output quantity data value by the support vector machine based module to provide a processed estimated output quantity data value based on a combined H-Q-SVM model via the support vector machine based module;

software code portions for supplying the processed received estimated output quantity data value instead of the estimated output quantity data value of the control module for subtraction;

software code portions for receiving the processed estimated output quantity data value from the support vector machine based module;

software code portions for receiving a measured output quantity data value of the pump provided by a sensor;

software code portions for providing a difference data value by subtracting the processed estimated output quantity data value from the received measured output quantity data value;

software code portions for comparing the difference data value with a predetermined threshold value and providing a corresponding comparison result;

software code portions for outputting an error status signal of the pump based on a result of the comparison.

* * * * *